US005857871A

United States Patent [19]

Horchler

[11] Patent Number: 5,857,871

[45] Date of Patent: Jan. 12, 1999

[54] ELECTRICAL CONNECTOR HOLD-DOWN

[75] Inventor: David C. Horchler, Millersburg, Pa.

[73] Assignee: Berg Technology, Inc., Reno, Nev.

[21] Appl. No.: 744,570

[22] Filed: Nov. 6, 1996

Related U.S. Application Data

[62] Division of Ser. No. 277,989, Jul. 20, 1994, Pat. No. 5,601,453.

[51] Int. Cl.[6] ..... H01R 13/73

[52] U.S. Cl. ..... 439/567; 439/571

[58] Field of Search ..... 439/567, 571, 439/82, 751, 851, 853; 24/453; 411/508–510, 913

[56] References Cited

U.S. PATENT DOCUMENTS

| | | | |
|---|---|---|---|
| 3,783,433 | 1/1974 | Kurtz et al. | 439/82 |
| 4,637,135 | 1/1987 | Grabbe | 29/832 |
| 4,659,156 | 4/1987 | Johnescu et al. | 339/17 C |
| 4,767,360 | 8/1988 | Bonhomme | 439/851 |
| 4,922,587 | 5/1990 | Pettit | 24/453 |
| 5,074,807 | 12/1991 | Parmer | 439/567 |
| 5,176,349 | 1/1993 | Bendorf | 248/220 |
| 5,178,561 | 1/1993 | Lindeberg et al. | 439/571 |
| 5,452,499 | 9/1995 | Schmidt et al. | 24/453 |

FOREIGN PATENT DOCUMENTS

| | | |
|---|---|---|
| 0 497 554 A1 | 8/1992 | European Pat. Off. . |
| 2 333 365 | 6/1977 | France . |
| WO 93/08619 | 4/1993 | WIPO . |

*Primary Examiner*—Gary F. Paumen

*Attorney, Agent, or Firm*—Woodcock Washburn Kurtz Mackiewicz & Norris LLP

[57] ABSTRACT

A hold-down for interconnecting an electrical connector and a printed circuit board where the hold-down has two bodies that multiple sides. When the bodies of the hold-down are inserted into the circular bores of the electrical connector and printed circuit board, the bodies form several points of contact which resist lateral and vertical movement of the interconnection between the electrical connector and PCB.

8 Claims, 12 Drawing Sheets

ELECTRICAL CONNECTOR HOLD-DOWN

This is a division, of application Ser. No. 08/277,989, filed Jul. 20, 1994 now U.S. Pat. No. 5,601,453, the disclosure of which is herein incorporated by reference.

FIELD OF THE INVENTION

The invention relates to a hold-down for electrical connectors, and more particularly to a multi sided hold-down for interconnecting an electrical connector to a printed circuit board ("PCB").

BACKGROUND OF THE INVENTION

Hold-downs are generally used to interconnect electrical connectors to other electrical connectors or PCBs. The type of hold-down used depends on the type of electrical connection being formed between the components. For example, if the electrical connection is a solderless form of connection, the hold-down used may be a rivet or nut and bolt combination. These form of hold-downs are necessary when the interconnection needs to minimize lateral (X & Y plane) movement relative to the interconnection.

Hold-downs may also need to resist unwanted vertical (Z plane) movement such as from mating and unmating forces. Although, rivets and nut and bolt combinations may be adequate, a hold-down at a lower manufacturing cost which provides adequate resistance to X, Y and Z plane movement is needed. In addition, a hold-down is needed that does not require any tools when used to form an interconnection between an electrical connector and a PCB.

SUMMARY OF THE INVENTION

The object of the invention is to provide a hold-down which resists movement in the X, Y and Z plane, which has a lower manufacturing cost than conventional hold-downs, and which does not require tools for its insertion into an electrical connector and a PCB when forming an interconnection of the electrical connector and the PCB.

To this end, a hold-down of the present invention for interconnecting a structure via a circular bore within the structure includes a body having a base portion, a first side portion, and a second side portion. The portions forming the body where the diameter of the smallest circle which encompasses the body is greater than the diameter of the circular bore within the structure.

In addition, the body has a gap formed between the ends of the first side portion and second side portion so that the diameter of the smallest circle which encompasses the body may be made smaller than the diameter of the circular bore within the structure so that the body of the hold-down may be inserted into the circular bore within the structure.

As a consequence, the body of the hold-down provides a plurality of points of contact against the side walls of the circular bore within the structure when the body is inserted in the bore because the diameter of the smallest circle that encompasses the body is greater than the diameter of the bore.

This embodiment of the invention may further include a second body connected to the body of the hold-down for interconnecting a second structure via a circular bore within the second structure to the structure interconnected by the body of the hold-down. The second body having a base portion, a first side portion, and a second side portion forming the second body where the diameter of the smallest circle which encompasses the second body is greater than the diameter of the circular bore within the second structure.

The second body also having a gap formed between the ends of the first side portion and second side portion so that the diameter of the smallest circle which encompasses the second body may be made smaller than the diameter of the circular bore within the second structure so that the second body of the hold-down may be inserted into the circular bore within the second structure, As a consequence, the second body of the hold-down provides a plurality of points of contact against the side walls of the circular bore within the second structure when the second body of the hold-down is inserted in the bore of the second structure because the diameter of the smallest circle which encompasses the second body is greater than the diameter of the bore of the second structure so that the structure and the second structure are interconnected by the body and the second body of the hold-down.

According to another embodiment of the invention, a hold-down of the present invention for interconnecting a structure via a circular bore within the structure includes a body having a plurality of portions. The portions forming the body where the diameter of the smallest circle which encompasses the body is greater than the diameter of the circular bore within the structure.

In addition, the body has a gap formed between ends of portions of the body so that the diameter of the smallest circle which encompasses the body may be made smaller than the diameter of the circular bore within the structure so that the body of the hold-down may be inserted into the circular bore within the structure.

As a consequence, the body of the hold-down provides a plurality of points of contact against the side walls of the circular bore within the structure when the body is inserted in the bore because the diameter of the smallest circle that encompasses the body is greater than the diameter of the bore.

This embodiment of the invention may further include a second body connected to the body of the hold-down for interconnecting a second structure via a circular bore within the second structure to the structure interconnected by the body of the hold-down. The second body having a plurality of portions forming the second body where the diameter of the smallest circle which encompasses the second body is greater than the diameter of the circular bore within the second structure.

The second body also having a gap formed between the ends of portions of the body so that the diameter of the smallest circle which encompasses the second body may be made smaller than the diameter of the circular bore within the second structure so that the second body of the hold-down may be inserted into the circular bore within the second structure.

As a consequence, the second body of the hold-down provides a plurality of points of contact against the side walls of the circular bore within the second structure when the second body of the hold-down is inserted in the bore of the second structure because the diameter of the smallest circle which encompasses the second body is greater than the diameter of the bore of the second structure so that the structure and the second structure are interconnected by the body and the second body of the hold-down.

According to another embodiment of the invention, a hold-down for interconnecting a first structure to a second structure via a circular bore within the first structure and a circular bore within the second structure includes a first body having a plurality of portions forming the first body where the diameter of the smallest circle which encompasses the first body is greater than the diameter of the circular bore within the first structure.

The first body having a gap formed between the ends of portions of the first body so that the diameter of the smallest circle which encompasses the first body may be made smaller than the diameter of the circular bore within the first structure so that the first body of the hold-down may be inserted into the circular bore within the first structure.

The embodiment also includes a second body having a plurality of portions forming the second body where the diameter of the smallest circle which encompasses the second body is greater than the diameter of the circular bore within the second structure.

The second body having a gap formed between the ends of portions of the second body so that the diameter of the smallest circle which encompasses the second body may be made smaller than the diameter of the circular bore within the second structure so that the second body of the hold-down may be inserted into the circular bore within the second structure where the diameter of the smallest circle which encompasses the first body is smaller than the diameter of the smallest circle which encompasses the second body.

Finally, the embodiment includes a shoulder connecting the first body to the second body where the shoulder is offset so that the first body and the second body are aligned along a common centerline.

BRIEF DESCRIPTION OF THE DRAWINGS

The invention will be described below in more detail with reference to the figures.

DETAILED DESCRIPTION OF PREFERRED EMBODIMENTS

Figure 1D:
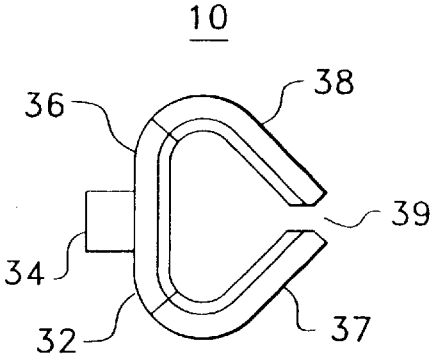
FIG. 1*d* shows a top view of the hold-down shown in FIG. 1*a*.
Figure 1A:
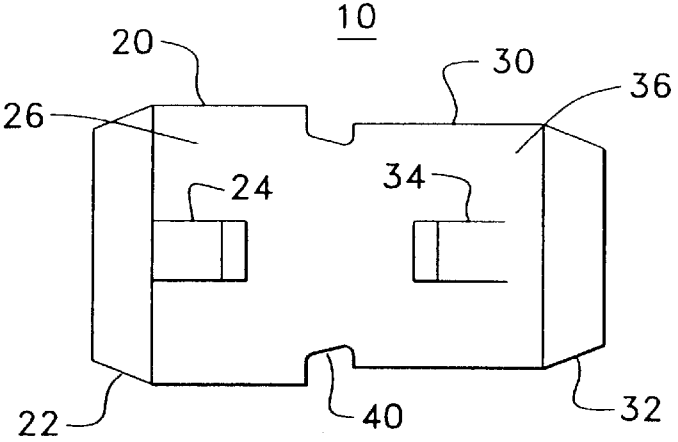
FIG. 1*a* shows a side view of a first preferred embodiment of a hold-down according to the invention.
Figure 1B:
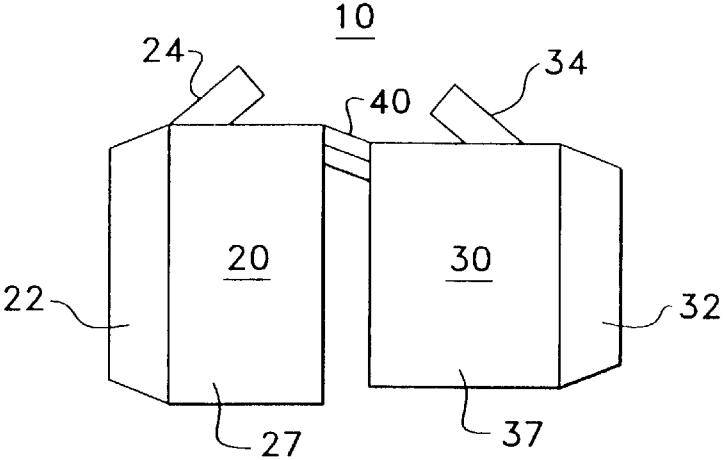
FIG. 1*b* shows a side view of the hold-down shown in FIG. 1*a* rotated 90 degrees.

FIGS. 1*a* to 1*d* show a first preferred embodiment of a hold-down 10 of the present invention for interconnecting two structures. The hold-down 10 as shown in FIGS. 1*a* to 1*d* has two bodies 20 and 30 which are connected by a shoulder 40 which offsets the two bodies so that they are aligned along a common centerline as shown in FIG. 1*b*. If the bodies have the same diameter, however, the shoulder 40 need not be offset to align the bodies along a common centerline.

Figure 1C:
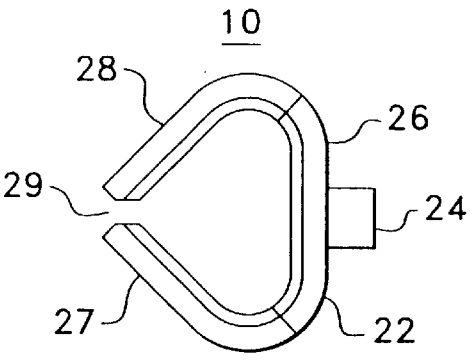
FIG. 1*c* shows a bottom view of the hold-down shown in FIG. 1*a*.

As shown in FIGS. 1*c* and 1*d*, in the first preferred embodiment of the invention, the bodies 20 and 30 have a substantially triangular shape when viewed from a horizontal perspective of the hold-down. Each body 20 and 30, includes a base portion 26 and 36, a first side wall portion 27 and 37, and a second side wall portion 28 and 38.

Referring to the first body 20 in detail, the base portion of the body 26 connects to the first side wall portion 27 and the second side wall portion 28 at the ends of the base portion. The first side wall portion 27 is attached to an end of the base portion 26 and extends at an acute angle from the base portion. The first side wall portion 27 extends to a centerline formed by bisecting the base portion 26 of the body 20.

The second side wall portion 28 extends at an acute angle from the other end of the base portion 26 of the body 20 towards a centerline formed by bisecting the base portion 26 of the body 20. The first side wall portion 27 and the second side wall portion 28 do not meet at the centerline but form a gap 29. The base portion 26, first side wall portion 27, and second side wall portion 28 form a substantially triangular shaped body having a first diameter where the body 20 extends in a vertical direction. Similarly, the body 30 has a base portion 36, first side wall portion 37, and second side wall portion 38 that form a substantially triangular shaped body having a second diameter where the body 30 also extends in a vertical direction.

In the preferred embodiment of the invention, the base portion 26 and 36 of the each body 20 and 30 of the hold-down 10 also includes a barb 24 and 34. The barb extends out vertically from top portion of each body toward to the bottom portion of the body. In the preferred embodiment of the invention, each body 20 and 30 of the hold-down 10 also has a beveled edge 22 and 32. The beveled edge 22 and 32 is formed on the base portion 26 and 36, first side wall portion 27 and 37, and second side wall portion 28 and 38. The interaction of the various components of the bodies 20 and 30 of the hold-down 10 is explained with reference to FIGS. 2*a* to 2*c*, 3*a* to 3*c*, and 4 below.

FIGS. 2*a* to 2*c* and 3*a* to 3*c*, show the hold-down shown in FIGS. 1*a* to 1*d* inserted into two structures 50 and 60 to form an interconnection of the structures. As shown in FIGS. 2*a* to 2*c* and 3*a* to 3*c*, the first body 20 is inserted in a first structure 50 and the second body 30 is inserted in a second structure 60. In the preferred embodiment of the invention, the first structure 50 is a printed circuit board, PCB and the second structure 60 is an electrical connector which is to be electrically coupled to the PCB.

The PCB 50 has a circular bore 52 having a first diameter and the electrical connector 60 also has a circular bore 62 having a second diameter where the circular bores are used to maintain engagement of the PCB 50 to the connector 60 via a hold-down. In the exemplary embodiment of the invention, the diameter of the circular bore 52 of the PCB 50 is larger than the circular bore 62 of the connector 60.

In particular, the diameter of bores of electrical connectors is commonly 0.100 inches and the diameter of bores of PCBs is commonly 0.120 inches. These sizes were selected in practice to accommodate prior art hold-downs such as rivets and nuts and bolts. As a consequence, different, in particular smaller, bore diameters may be used for the hold-downs of the present invention.

As will be discussed further below, the diameters of the smallest circles that would encompass the bodies 20 and 30 of the hold-down 10 of the present invention are larger than the corresponding diameters of the circular bores that the bodies are to be inserted into to provide engagement therewith. In particular, the diameter of the smallest circle that would encompass the first body 20 (which is inserted in the circular bore 52 of the PCB 50) is larger than the diameter of the circular bore 52 of the PCB 50. As a consequence, the base portion 26, first side wall portion 27 and the second side wall portion 28 exert lateral forces against the side walls of the circular bore 52 of the PCB 50 when the body 20 is inserted in the bore 52.

Similarly, the diameter of the smallest circle that would encompass the second body 30 which is inserted in the circular bore 62 of the electrical connector 60 is larger than the diameter of the circular bore 62 of the connector 60. As a consequence, the base portion 36, the first side wall portion 37 and the second side wall portion 38 exert lateral forces against the side walls of the circular bore 62 of the connector 60 when the body 30 is inserted in the bore 62.

In addition, in the preferred embodiment of the invention, the diameter of the second body 30 (which is inserted in the connector 60) is smaller than the diameter of the first body 20 (which is inserted in the PCB 50) due to the fact that in the preferred embodiment of the invention, the diameter of the circular bore 62 of the electrical connector 60 is smaller than the diameter of the circular bore 52 of the PCB 50. As noted above, as a consequence of the different sizes of the bodies in the preferred embodiment of the invention, the shoulder 40 offsets the bodies so that the bodies are aligned along a common centerline.

Figure 2C:
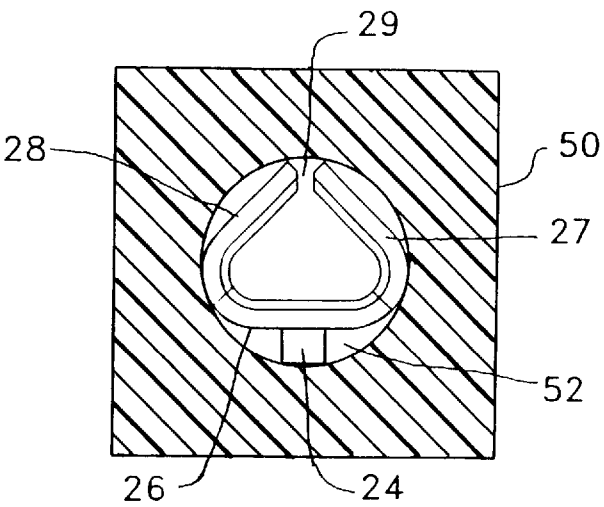
FIG. 2*c* shows a bottom view in partial Cross-Section of the hold-down shown in FIG. 2*a*.
Figure 2A:
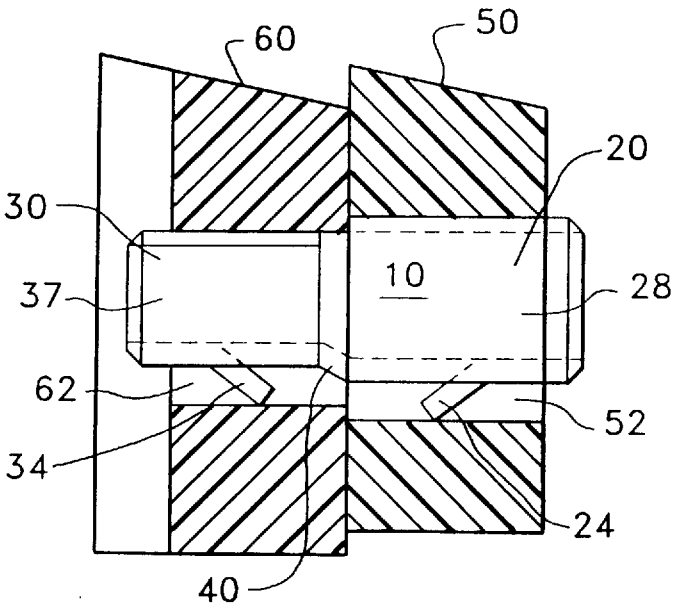
FIG. 2*a* shows a side view in partial Cross-Section of the first preferred embodiment of a hold-down interconnecting two structures according to the invention.
Figure 2B:
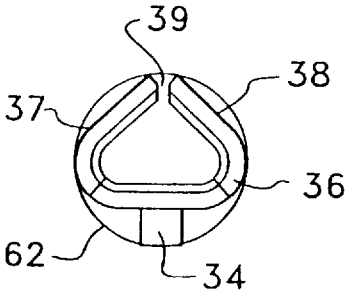
FIG. 2*b* shows a bottom view in partial Cross-Section of the hold-down shown in FIG. 2*a*.
Figure 3C:
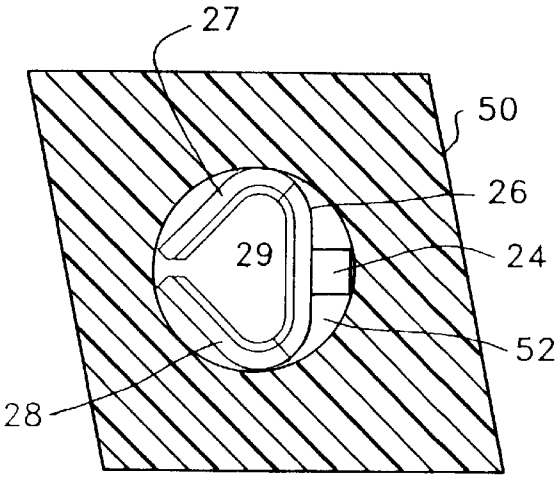
FIG. 3*c* shows a bottom view in partial Cross-Section of the hold-down shown in FIG. 3*a*.
Figure 3A:
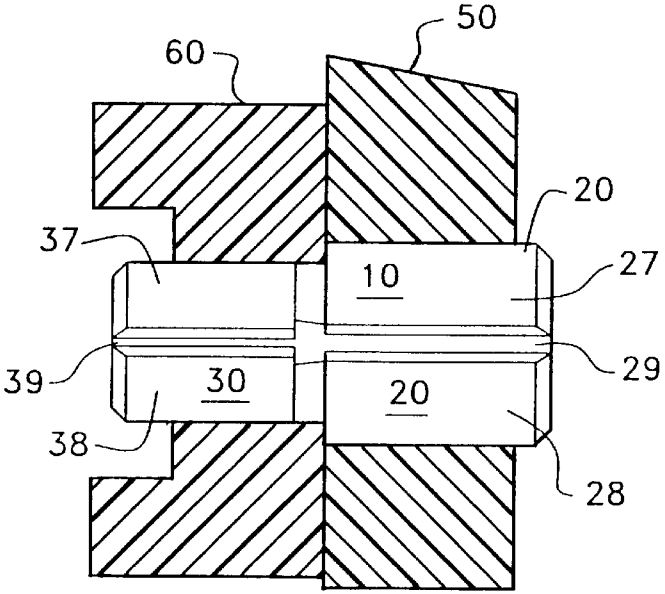
FIG. 3*a* shows another side view in partial Cross-Section of the first preferred embodiment of a hold-down interconnecting two structures according to the invention.
Figure 3B:
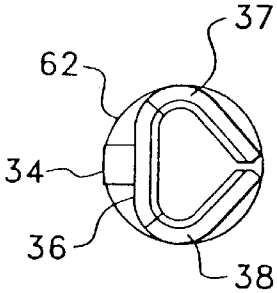
FIG. 3*b* shows a bottom view in partial Cross-Section of the hold-down shown in FIG. 3*a*.

As a consequence, the shoulder 40 extends at angle between the first and second bodies 20 and 30 as shown in FIGS. 1*b* and 2*a* due to the fact that the diameter of the second body 30 is smaller than the diameter of the first body 20 of hold-down 10, in the preferred embodiment of the invention. In this configuration, the shoulder 40 helps align the two bodies 20 and 30 of the hold-down 10 in the respective bores 52 and 62 of the PCB 50 and the connector 60. The offset shoulder 40 of the preferred embodiment of the invention enables an individual to insert the hold-down of the present invention into an electrical connector and PCB to form an interconnection therebetween without the need of tools.

In the preferred embodiment of the invention, an individual follows a simple two step process to interconnect an electrical connector and PCB using a hold-down of the present invention due to the offset of the shoulder 40. In particular, the individual first inserts the smaller body 30 of the hold-down 10 into the bore 62 of an electrical connector 60 until the shoulder 40 engages the edge of the bore 62. Due to the fact that shoulder 40 is offset, the shoulder 40 forms a circle having a diameter greater than the diameter of the bore 62 and thus the shoulder 40 will engage the edge of the bore 62 of the connector 60 when inserted.

To complete the interconnection process, the individual then inserts the other body 20 into a corresponding bore 52 of a PCB 50 to be interconnected with the electrical connector 60 by aligning the body 20 over the bore 52 and pressing down on the electrical connector 60 towards the PCB 50. Due to the fact that the shoulder 40 is offset, as note above, the body 20 will be engage the bore 52 of the PCB 50 and not travel into any portion of the bore 62 of the electrical connector 60 as the electrical connector 60 is being pressed toward the PCB 50 to interconnect them via the hold-down of the present invention. As a consequence, an individual can interconnect an electrical connector to a PCB with a hold-down of the present invention without the aid of tools.

In the preferred first embodiment of the invention, the bodies 20 and 30 of the hold-down 10 also have barbs 24 and 34 extending from the base portions 26 and 36. The barb 24 extends horizontally to a distance greater than or equal to the diameter formed by the smallest circle which encompasses the body 20. Likewise, the barb 34 also extends horizontally to a distance greater than or equal to the diameter formed by the smallest circle which encompasses the body 30. As a consequence, when the body 20 is inserted in the circular bore 52 of PCB 50, the barb 24 provides lateral force against the side wall of the circular bore 52 of the PCB 50.

In particular, due to the fact that the barb extends out vertically from the top of the body 20, the lateral force exerted by the barb 24 is increased by any vertical force in a direction towards the top of the body 20, i.e., away from the mating connection with the electrical connector 60.

Similarly, when the body 30 is inserted in the circular bore 62 of the electrical connector 60, the barb 34 provides lateral force against the side wall of the circular bore 62 of the electrical connector 60. In particular, due to the fact that the barb extends out vertically from the top of the body 30, the lateral force exerted by the barb 34 is also increased by any vertical force in a direction towards the top of the body 30, i.e., away from the mating connection with the PCB 50. As a consequence, the barbs 24 and 34 work together to limit any vertical movement of the electrical connector 60 and the PCB 50 away from each other.

As noted above, in the preferred embodiment of the invention, each body 20 and 30 of the hold-down 10 has a beveled edge 22 and 32 at its top. The beveled edge 22 and 32 is provided to facilitate the insertion of the body 20 or 30 into a structure by an individual without the aid of tools. As also noted above, the bodies are inserted into a circular bore of a structure having a diameter smaller than the diameter formed by the body 20 or 30. As a consequence, the body must be compressed prior or while being inserted into the circular bore of the structure.

The beveled edge 22 or 32 allows the body to be inserted partially into the circular bore of the structure without compression and then the necessary compression forces are generated by the walls of the circular bore of the structure when the body 20 or 30 is inserted further into the circular bore of the structure. As a consequence, an individual inserting the hold-down of the present invention into an electrical connector or PCB does not need to use a tool to compress the hold-down.

As also noted above, the first side wall portion 27 and 37 and second side wall portion 28 and 38 of a body 20 and 30 form a gap 29 and 39. The gap 29 and 39 enables the body to be compressed to a body having smaller diameter (the diameter formed by the smallest circle when encompasses the compressed body) during the insertion process into a circular bore of a structure having a diameter smaller than the uncompressed diameter formed by the smallest circle which encompasses a body 20 and 30.

The gap 29 and 39 also permits the exact diameter of the circular bore of the structure to be variable, i.e., not subject to strict tolerance, since, depending on the size of the gap 29 and 39, the diameter formed by the body 20 and 30 may be compressed to a range of sizes. As a consequence, the manufacturing costs of a electrical connector or PCB may be reduced since the precision required to generate the bores used to interconnect the devices need not be as great using a hold-down of the present invention.

Figure 4:
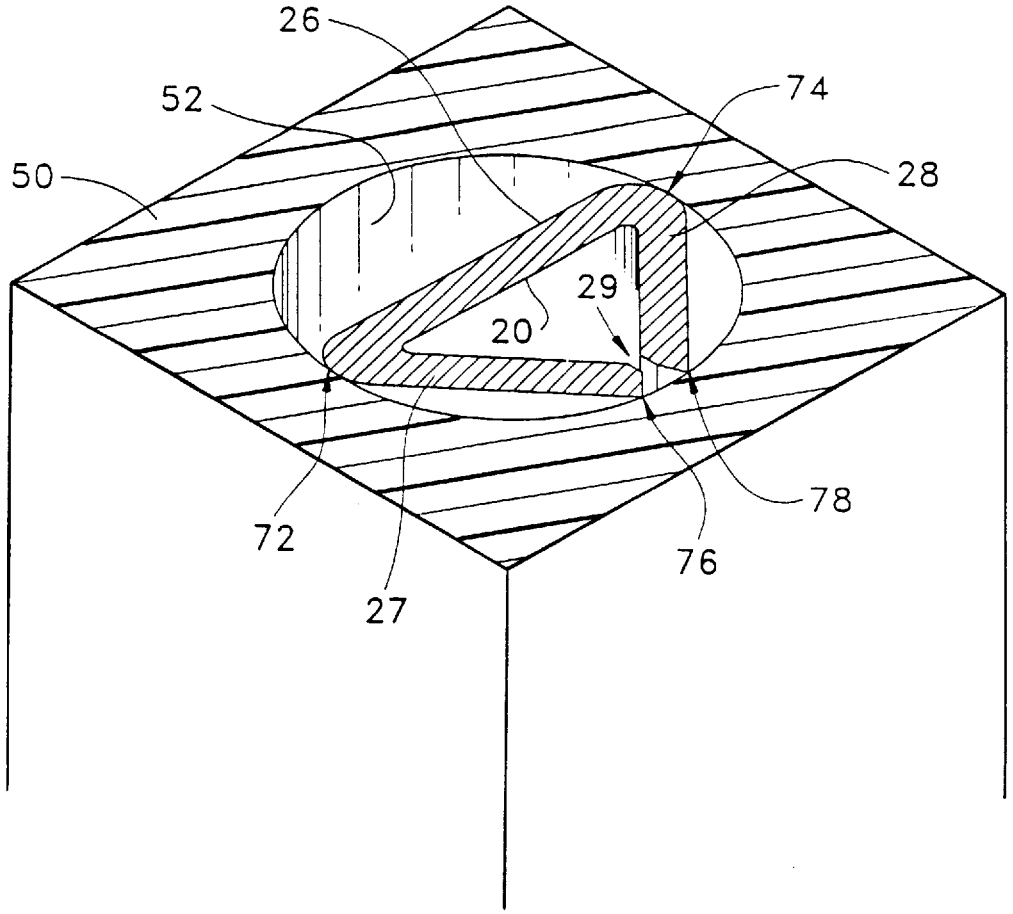
FIG. 4 shows a top view in partial Cross-Section of the first preferred embodiment of a hold-down of the present invention.
Figure 4:
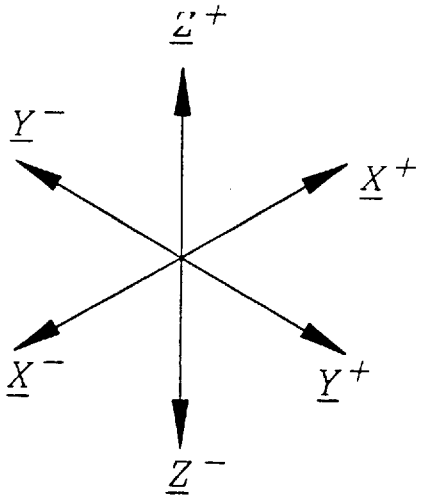

FIG. 4 shows lines of contact made between the body 20 when inserted into the circular bore 52 of the PCB 50, for example. As noted above, the diameter of the circular bore 52 of the PCB 50 is smaller than the uncompressed diameter formed by the smallest circle which encompasses the body 20 of the hold-down 10. As a consequence, portions of the body 20 exert a force against the side walls of the circular bore 52 of the PCB 50.

In particular, the end of the base portion 26 which is connected to the first side wall portion 27, forms a line of contact 72 with the side wall of the circular bore 52. As shown by the planar diagram, this line of contact exerts forces in the X-Y plane. The other end of the base portion 26 which is connected with the second side wall portion 28, also forms a line of contact 74 with the side wall of the circular bore 52. This line of contact also exerts forces in the X-Y plane.

The ends of the first side wall portion 27 and second side wall portion 28 also form lines of contact 76 and 78. These lines of contact 76 and 78 also exert forces in the X-Y plane. Similarly, the body 30 of the hold-down 10 exerts forces against the side walls of the circular bore 62 of the electrical connector 60 when inserted. As a consequence, the bodies 20 and 30 of the present invention are effective at limiting lateral movement of the PCB 50 relative to the interconnection of an electrical connector 60 to a PCB 50. The limitation of lateral movement is critical for certain forms of electrical connections including solderless electrical connections.

Figure 5B:
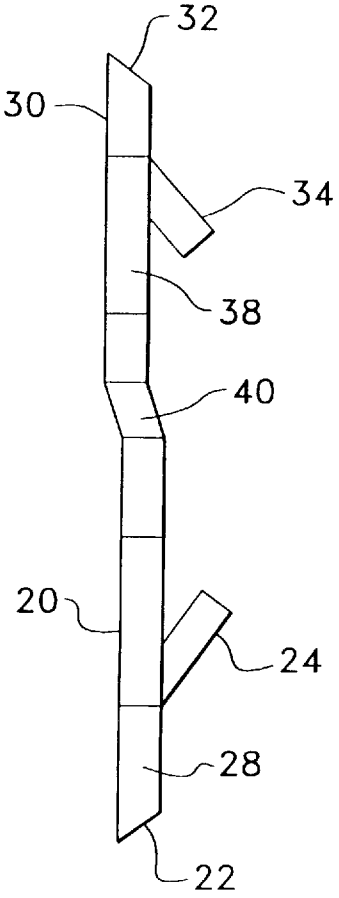
FIG. 5*b* shows a side view of the hold-down shown in FIG. 5*a*.
Figure 5A:
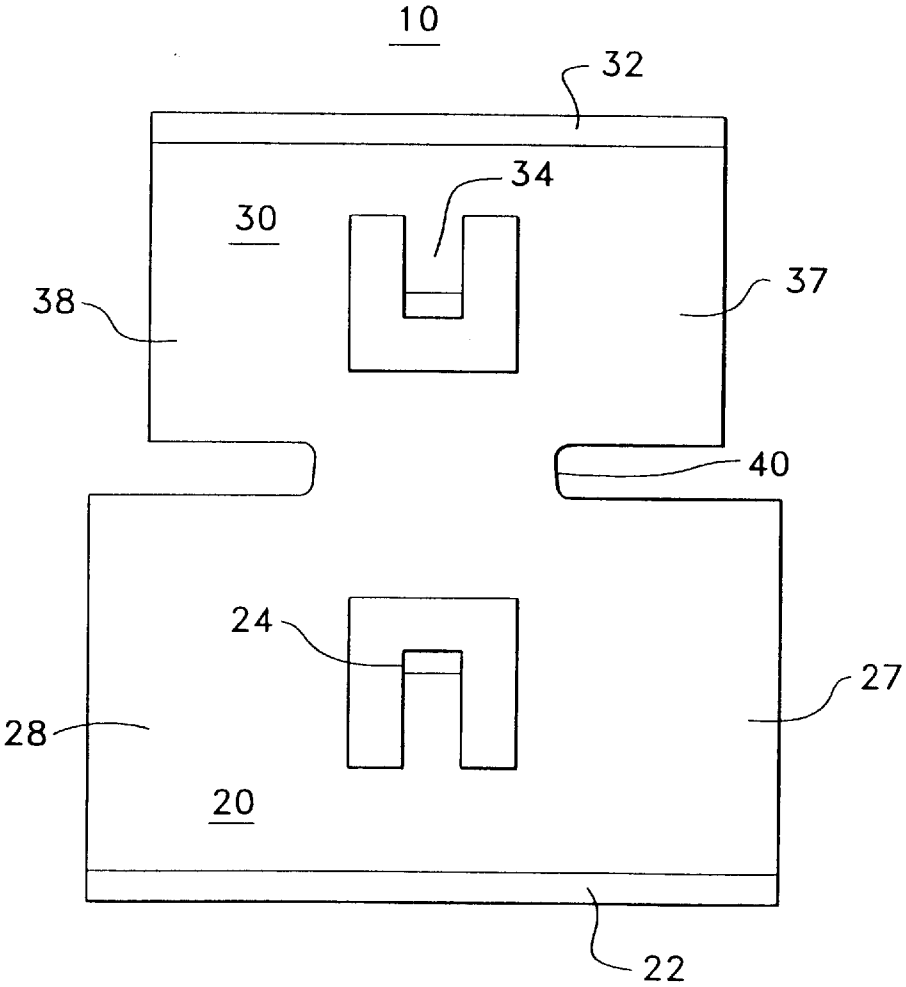
FIG. 5*a* shows the first preferred embodiment of a hold-down of the present invention in a stage of manufacturing.

FIGS. 5*a* and 5*b* show a preferred method of manufacturing the first preferred embodiment of the hold-down 10 as shown in FIGS. 1–4. In particular, as shown in FIG. 5*a*, the hold-down 10 is first stamped from metal, such as sheet metal, phosphor bronze, brass, stainless steel, or brilliant copper, into a flat piece of metal as shown in FIG. 5*a*. The metal is flat except for the protrusion of the barbs as shown in FIG. 5*b*.

To complete the manufacture of the hold-down 10 of the present invention, the bodies 20 and 30 of the hold-down are bent at the ends of the base portions 26 and 36 of the bodies 20 and 30 so that the first side wall portions 27 and 37 and the second side wall portions 28 and 38 extend at an acute angle relative to the base portion 26 and 36 towards a centerline formed by bisecting the base portion 26 and 36 and form a gap 29 and 39. Finally, the bodies are aligned along a common centerline (such as shown in FIG. 1*b*) by offsetting the shoulder 40.

Thus, the hold-down 10 of the present invention may be easily formed by stamping out the pattern shown in FIGS. 5*a* and 5*b* and by folding side wall portions of the bodies 20 and 30 of the hold-down about the base portions 26 and 36 of the bodies 20 and 30 and aligning the bodies along a common centerline by offsetting the shoulder 40.

As noted above, an individual may insert the hold-down of the present invention into an electrical connector and a PCB with the aid of tools. In some particular applications, the alignment of the electrical connector to the PCB is critical, i.e., there is little tolerance. For example, if the electrical connector has a high density of pins, it may be necessary to use an alignment tool to aid in the interconnection of the electrical connector to the PCB to avoid possibly bending the pins or damaging the PCB.

Figure 6A:
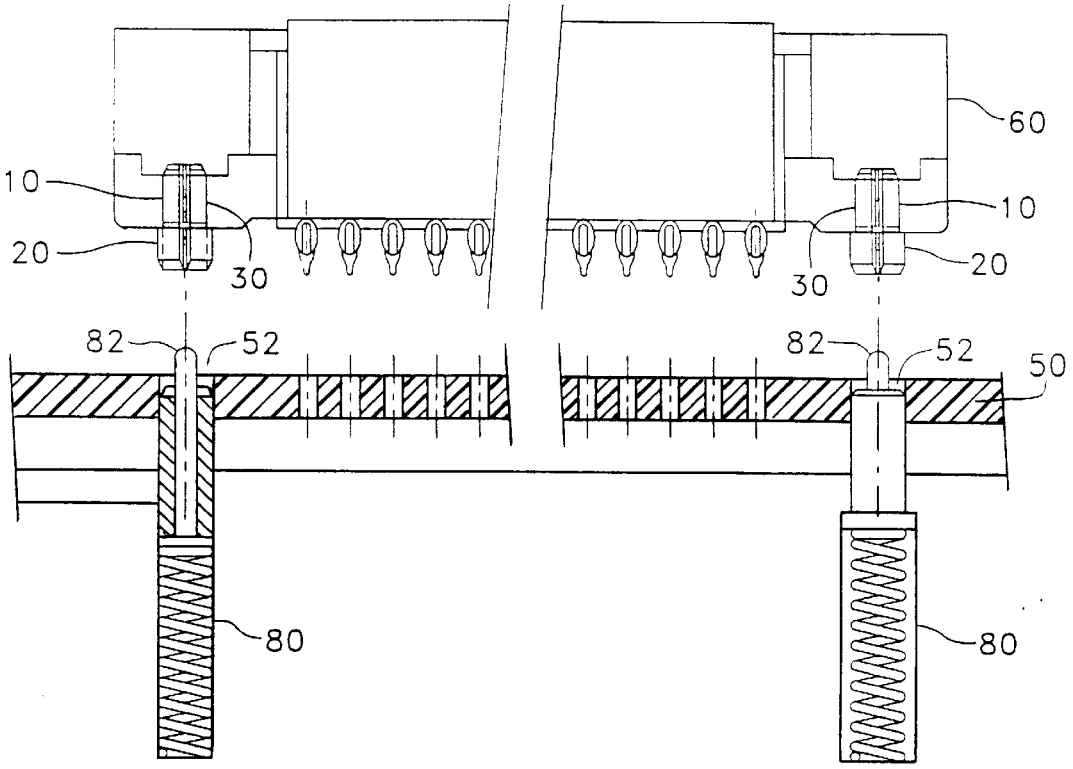
FIG. 6*a* shows two hold-downs according to the invention in the process of being inserting into a circuit board via an insertion tool to form an interconnection between an electrical connector and the printed circuit board.
Figure 6B:
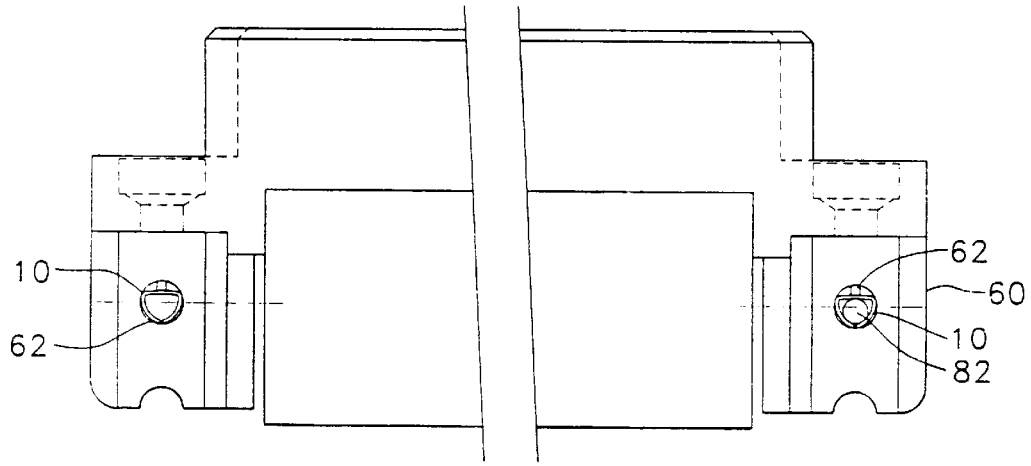
FIG. 6*b* shows a top view of the hold-downs and electrical connector as shown in FIG. 6*a*.
Figure 7:
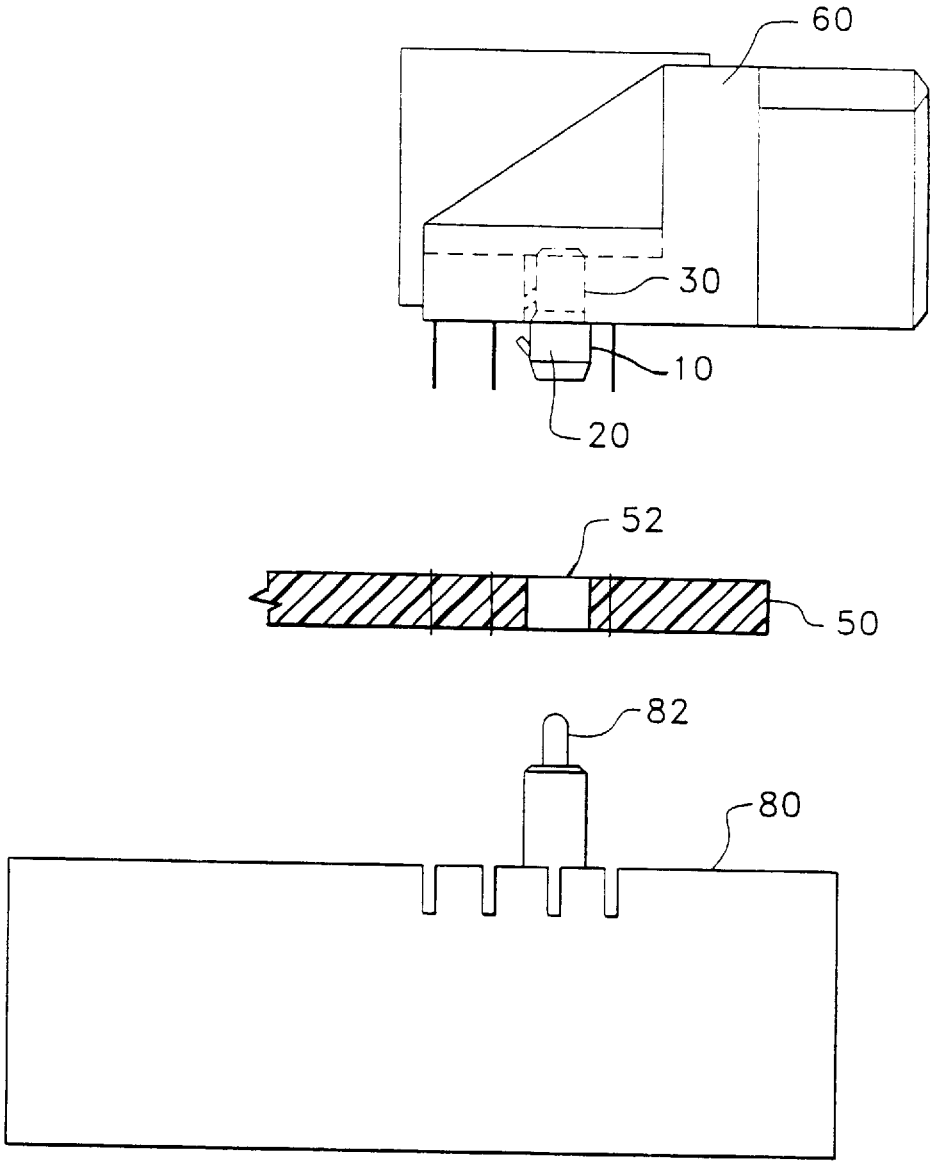
FIG. 7 shows a hold-down according to the invention in the process of being inserting into a circuit board via an insertion tool to form an interconnection between an electrical connector and the printed circuit board and is a side view of FIG. 6*a*.
Figure 8A:
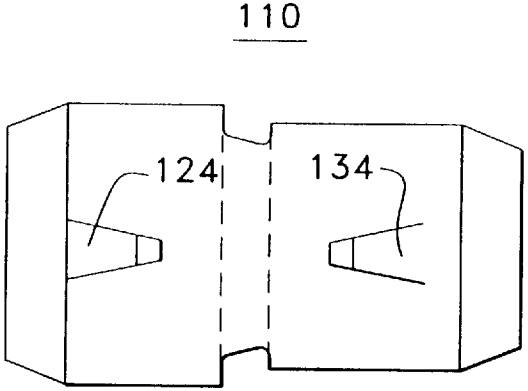
FIG. 8*a* shows a side view of a second preferred embodiment of a hold-down according to the invention.
Figure 8B:
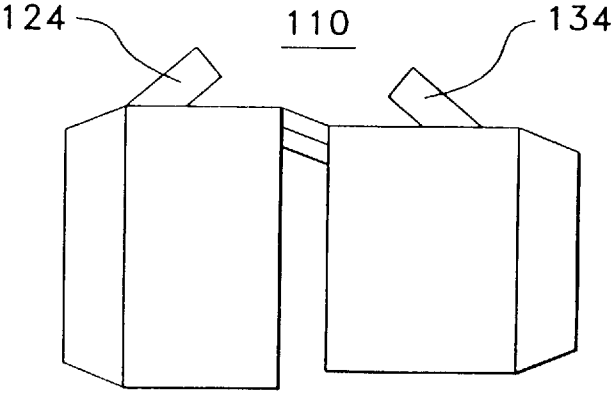
FIG. 8*b* shows a side view of the hold-down shown in FIG. 8*a* rotated 90 degrees.
Figure 8C:
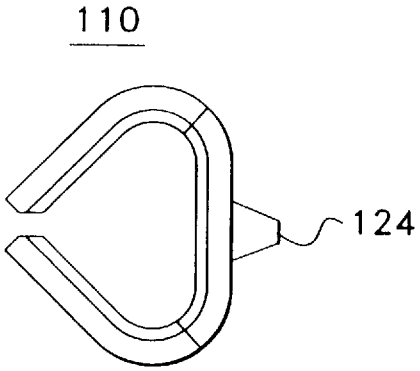
FIG. 8*c* shows a bottom view of the hold-down shown in FIG. 8*a*.
Figure 8D:
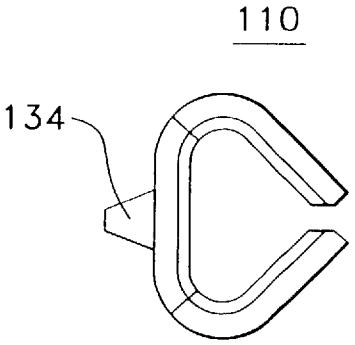
FIG. 8*d* shows a top view of the hold-down shown in FIG. 8*a*.

FIGS. 6*a*, 6*b*, and 7 show a method of inserting the body 20 of the hold-down 10 into the circular bore 52 of a PCB 50 using an alignment tool 80 for special applications. As shown in these Figures, the alignment tool 80 is a spring loaded insertion tool 80 which is used to guide the insertion of the body 20 of the hold-down 10 into the circular bore 52 of the PCB 50 after the body 30 of the hold-down 10 has already been inserted into the electrical connector 60.

In particular, the insertion tool 80 is first inserted into the bore 52 so that the insertion pin 82 extends through the circular bore 52. The body 20 of the hold-down 10 is placed over the insertion pin 82 where the pin 82 fits within the gap formed by the base portion 26, the first side wall portion 27, and the second side wall portion 28.

Downward pressure towards the PCB 50 is then applied against the electrical connector 60. When the pressure applied, the insertion pin 82 then guides the first body 20 of the hold-down 10 into the circular bore 52 of the PCB 50. As a consequence, the pins of the electrical connector 60 will be precisely aligned during the insertion process into the PCB 50 thus avoiding the possibility of bending pins or damaging the PCB 50.

FIG. 6*b* is a top view of the process which shows the insertion pin 82 in the gap formed by the base portion 26, the first side wall portion 27, and the second side wall portion 28. FIG. 7 is a side view of the insertion process shown in FIG. 6*a*.

FIGS. 8*a* to 8*d* show a second preferred embodiment of the invention. In this embodiment of the invention, the hold-down 110 has barbs 124 and 134 extending from the base portions 26 and 36 that are triangular in shape. Similar to the barbs shown in FIGS. 1*a* to 1*d*, barbs 124 and 134 extend horizontally to a distance greater than or equal to the diameter formed by the smallest circle which encompasses the bodies of the hold-down 110. Additional modifications that may be to hold-down of the present invention to increase the lateral and vertical stability of the hold-down are shown in FIGS. 9*a* to 9*c*.

Figure 9A:
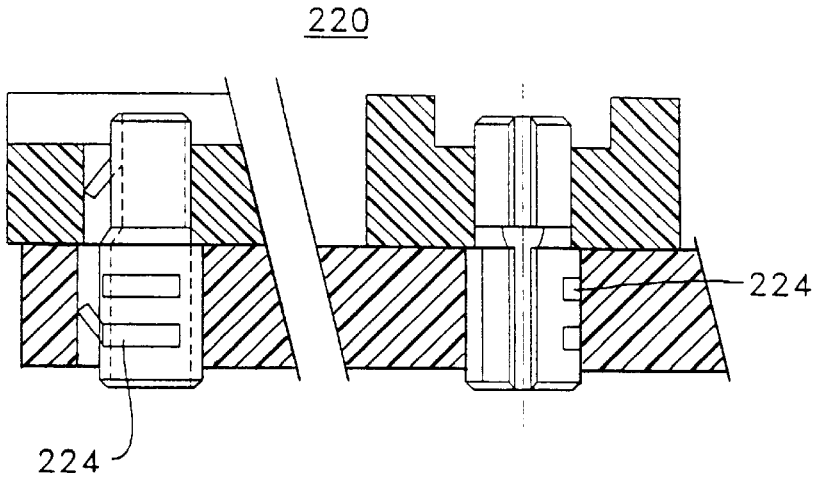
FIG. 9*a* shows two side views in partial Cross-Section of the first preferred embodiment of a hold-down according to the invention additionally having retentive bumps.
Figure 9B:
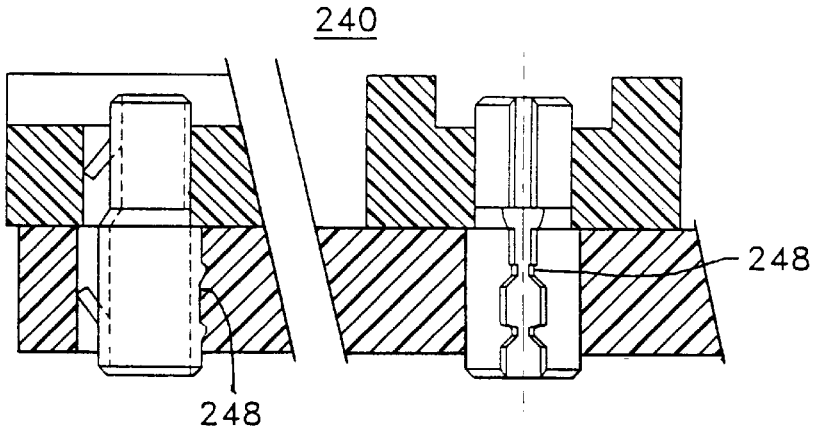
FIG. 9*b* shows two side views in partial Cross-Section of the first preferred embodiment according to the invention of a hold-down additionally having stamped barbs.
Figure 9C:
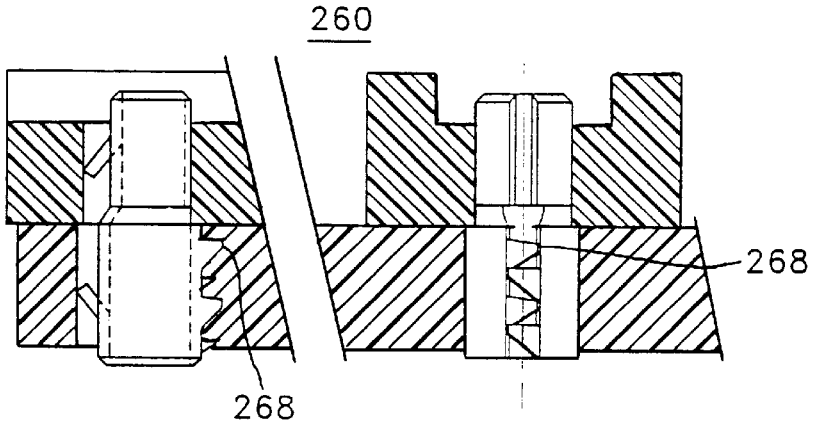
FIG. 9*c* shows two side views in partial Cross-Section of the first preferred embodiment according to the invention of a hold-down additionally having interlocking stamped barbs.

In particular, as shown in FIG. 9*a*, one or more retentive bumps 224 may be added to one or more sides 27, 28, 37, and 38 of the hold-down 220. These bumps 224 increase the number of the points of contact between the hold-down of the present invention and the electrical connector 60 and the PCB 50. In addition, as shown in FIGS. 9*b* and 9*c*, respectively, stamped barbs 248 or interlocking barbs 268 may be formed on the edges of the sides 27, 28, 37, and 38 where the gap 29 or 39 is formed in the bodies 20 or 30 of a hold-down 240 or 260. These barbs 248 or 268 increase the number of the points of contact between the hold-down of the present invention and the electrical connector 60 and the PCB 50.

Although, in the first preferred embodiment of the invention, the hold-down forms a substantially triangular shape when viewed from a horizontal perspective, hold-downs of other preferred embodiments of the invention may form other shapes when viewed from a horizontal perspective as shown in FIGS. 10*a*, 10*b*, 11*a*, and 11*b*. In particular, in FIGS. 10*a* and 10*b*, a third preferred embodiment of a hold-down 410 is shown which is rectangular in shape when viewed from a horizontal perspective.

Figure 10A:
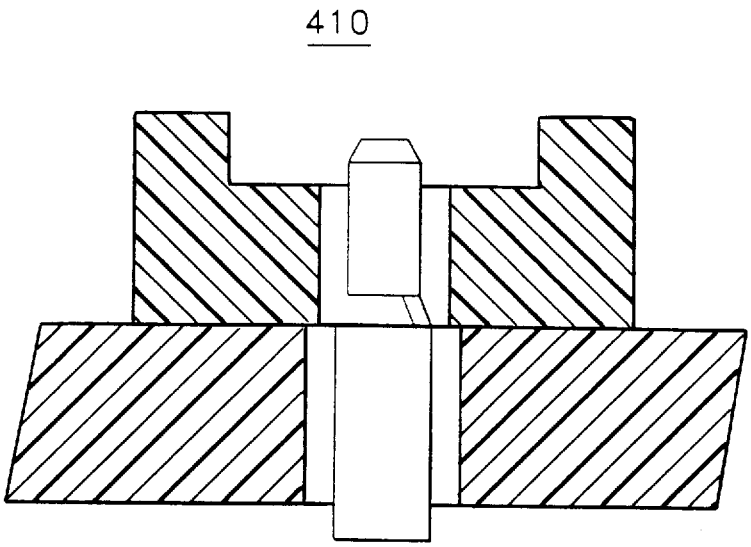
FIG. 10*a* shows a side view in partial Cross-Section of a third preferred embodiment of a hold-down interconnecting two structures according to the invention.
Figure 10B:
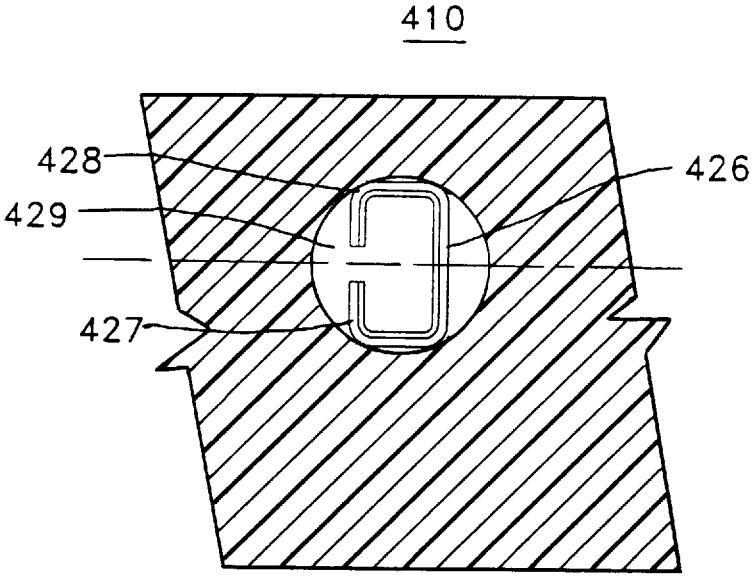
FIG. 10*b* shows a bottom view in partial Cross-Section of the hold-down shown in FIG. 10*a*.

As shown in FIG. 10*b*, in the third preferred embodiment of the invention, the bodies have a substantially rectangular shape when viewed from a horizontal perspective of the hold-down. Each body includes a base portion 426, a first multiple side wall portion 427 and a second multiple side wall portion 438. The base portion 426 connects to the first multiple side wall portion 427 and the second multiple side wall portion 428 at the ends of the base portion.

The multiple side wall portions 427 and 428 are attached to the ends of the base portion 426 and form an L-shape from the base portion. The multiple side wall portions 427 and 428 extend toward a centerline formed by bisecting the base portion 426. Similar to the first preferred embodiment of the invention, the first multiple side wall portion 427 and second multiple side wall portion 428 form a gap 429.

The gap 429 enables the body to be compressed to a body having a smaller diameter (the diameter formed by the smallest circle when encompasses the compressed body) during the insertion process into a circular bore of a structure having a diameter smaller than the uncompressed diameter formed by the smallest circle which encompasses a body of the hold-down 410.

The gap 429 also permits the exact diameter of the circular bore of the structure to be variable, i.e., not subject to strict tolerance, since, depending on the size of the gap 429, the diameter formed by the body may be compressed to a range of sizes. Another preferred of the invention is shown in FIGS. 11*a* and 11*b*.

Figure 11A:
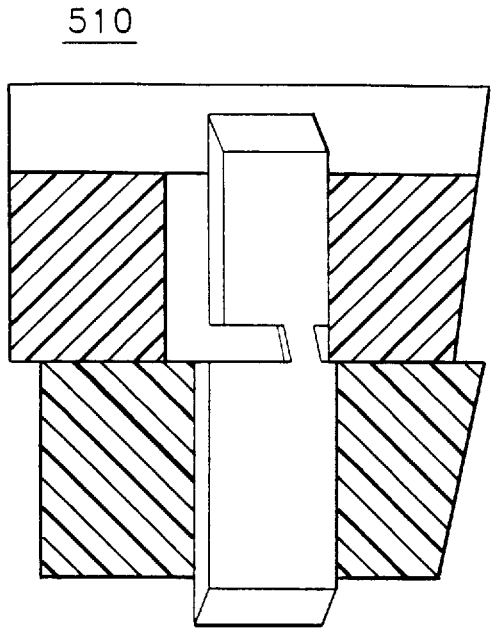
FIG. 11*a* shows a side view in partial Cross-Section of a fourth preferred embodiment of a hold-down interconnecting two structures according to the invention.
Figure 11B:
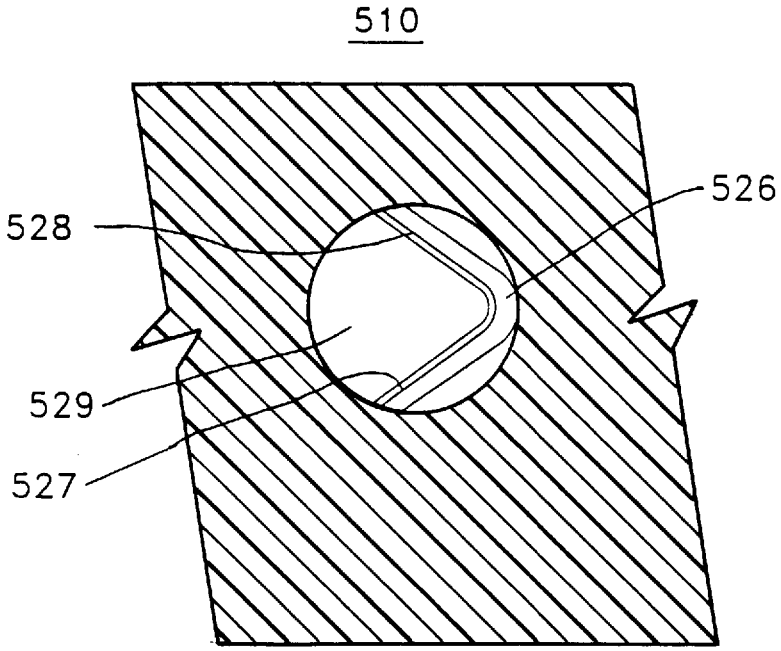
FIG. 11*b* shows a bottom view in partial Cross-Section of the hold-down shown in FIG. 11*a*.

FIGS. 11*a* and 11*b* show a fourth preferred embodiment of a hold-down 410 which is V shaped when viewed from a horizontal perspective. As shown in FIG. 11*b*, in the third preferred embodiment of the invention, the bodies have a substantially V shape when viewed from a horizontal perspective of the hold-down. As for the other preferred embodiments of the invention, each body includes a base portion 526, a first side wall portion 527 and a second side wall portion 538. The base portion 526 connects to the first side wall portion 527 and the second side wall portion 528 at the ends of the base portion, thus the base portion 526 may only be the intersection of the side wall portions 527 and 528 so that, in effect, the bodies of the hold-down 510 are formed from only two sides.

The side wall portions 527 and 528 are attached to the ends of the base portion 526 and at an obtuse angle from the base portion. The side wall portions 527 and 528 extend away from a centerline formed by bisecting the base portion 526. Similar to the other preferred embodiments of the invention, the first side wall portion 527 and second side wall portion 528 form a gap 529.

The gap 529 also enables the body to be compressed to a body having smaller diameter (the diameter formed by the smallest circle when encompasses the compressed body) during the insertion process into a circular bore of a structure having a diameter smaller than the uncompressed diameter formed by the smallest circle which encompasses a body of the hold-down 510.

The gap 529 also permits the exact diameter of the circular bore of the structure to be variable, i.e., not subject to strict tolerance, since, depending on the size of the gap 529, the diameter formed by the body may be compressed to a range of sizes.

Although not shown in FIGS. 10*a*, 10*b*, 11*a* and 11*b*, these embodiments of the invention may also have barbs as illustrated in FIGS. 1*a* to 1*d* or 8*a* to 8*d* or retentive bumps or stamped barbs as shown in FIGS. 9*a* to 9*c*.

Figure 12:
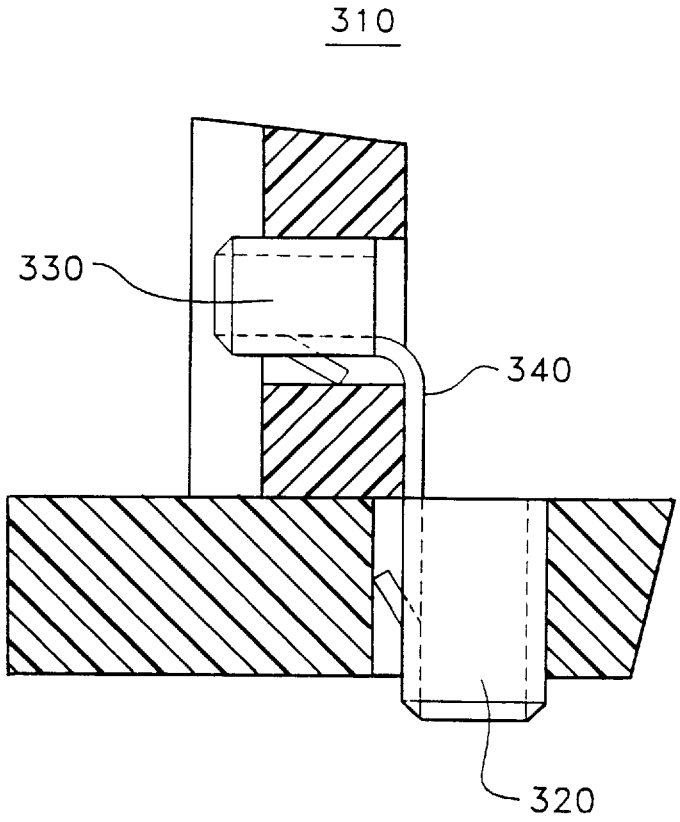
FIG. 12 shows a side view in partial Cross-Section of a fifth preferred embodiment of a right angle hold-down interconnecting two structures at right angles according to the invention.

It will be evident that other embodiments of the holddown are possible without departing from the scope of the invention. For example, a hold-down capable of interconnecting a right angle electrical connector to a PCB may be formed by extending the length of the shoulder 340 of the hold-down 310 of the present invention and bending the shoulder to form a right angle as shown in FIG. 12. The bodies 330 and 320 of the hold-down 310 as shown in FIG. 12 extend at rights angles from the shoulder portion 340. In addition, the hold-down may have a conventional hold-down such as a rivet or bolt attached to a body 20 or 30 of the present invention. In addition, an electrical connector may have a body 20 or 30 extending from a portion to engage another connector or printed circuit board and thus have a single body hold-down.

What is claimed is:

1. A hold-down adapted to connect to a structure via a circular bore formed within the structure, said hold-down comprising:

a body having a base portion, a first side portion, and a second side portion wherein the body is substantially triangular in shape when viewed from a horizontal perspective, the diameter of the smallest circle which encompasses the body when viewed from a horizontal perspective is greater than the diameter of the circular bore within the structure, the body having a gap formed between ends of the first side portion and second side portion wherein the diameter of the smallest circle which encompasses the body may be made smaller than the diameter of the circular bore within the structure so that the body of the hold-down may be inserted into the circular bore within the structure, and wherein the body of the hold-down provides contact against side walls of the circular bore within the structure when the body of the hold-down is inserted in the bore, wherein a barb is formed on the base portion extending vertically from the end to be inserted in the circular bore of the structure and projecting outwardly from the body as it extends vertically, wherein a barb is not formed on either the first or second side portion, and wherein the barb prevents vertical movement of the hold-down once inserted into the circular bore of the structure.

2. The hold-down according to claim 1, wherein the body has a beveled edge for easing the insertion of the body of the hold-down into the circular bore of the structure.

3. The hold-down according to claim 2, wherein the structure is an electrical connector.

4. The hold-down according to claim 2, wherein the structure is a circuit board.

5. A hold-down adapted to connect to a structure via a circular bore formed within the structure, said hold-down comprising:

a body having a plurality of portions wherein the body is substantially triangular in shape when viewed from a horizontal perspective, the diameter of the smallest circle which encompasses the body when viewed from a horizontal perspective is greater than the diameter of the circular bore within the structure the body having a gap formed between the ends of portions of the body wherein the diameter of the smallest circle which encompasses the body may be made smaller than the diameter of the circular bore within the structure so that the body of the hold-down may be inserted into the circular bore within the structure, and wherein the body of the hold-down provides contact against side walls of the circular bore within the structure when the body of the hold-down is inserted in the bore, wherein one of said plurality of portions is a base portion and a barb is formed on the base portion extending vertically from the end to be inserted in the circular bore of the structure and projecting outwardly from the body as it extends vertically, wherein a barb is not formed on any of said plurality of portions other than the base portion, and wherein the barb prevents vertical movement of the hold-down once inserted into the circular bore of the structure.

6. The hold-down according to claim 5, wherein the body has a beveled edge for easing the insertion of the body of the hold-down into the circular bore of the structure.

7. The hold-down according to claim 6, wherein the structure is an electrical connector.

8. The hold-down according to claim 6, wherein the structure is a circuit board.

* * * * *